US010351976B2

(12) United States Patent
Stephan

(10) Patent No.: US 10,351,976 B2
(45) Date of Patent: Jul. 16, 2019

(54) SPINNING MACHINE AND METHOD FOR OPERATING A SPINNING MACHINE WITH A MULTIPLE NUMBER OF SPINNING STATIONS

(71) Applicant: Rieter Ingolstadt GmbH, Ingolstadt (DE)

(72) Inventor: Adalbert Stephan, Beilngries/Paulushofen (DE)

(73) Assignee: Rieter Ingolstadt GmbH, Ingolstadt (DE)

( * ) Notice: Subject to any disclaimer, the term of this patent is extended or adjusted under 35 U.S.C. 154(b) by 329 days.

(21) Appl. No.: 15/203,963

(22) Filed: Jul. 7, 2016

(65) Prior Publication Data

US 2017/0009386 A1 Jan. 12, 2017

(30) Foreign Application Priority Data

Jul. 8, 2015 (DE) ..... 10 2015 110 992

(51) Int. Cl.
*D01H 15/00* (2006.01)
*D01H 4/44* (2006.01)
*D01H 4/48* (2006.01)

(52) U.S. Cl.
CPC ..... *D01H 15/00* (2013.01); *D01H 4/44* (2013.01); *D01H 4/48* (2013.01)

(58) Field of Classification Search
CPC ..... D01H 13/005; D01H 15/013; D01H 4/48
See application file for complete search history.

(56) References Cited

U.S. PATENT DOCUMENTS 4,532,759 A * 8/1985 Bischofberger ..... B65H 54/26 242/473.6
5,386,684 A * 2/1995 Simon ..... B65H 54/26 57/264
6,226,971 B1 * 5/2001 Stephan ..... B65H 54/26 57/263
6,907,309 B2 * 6/2005 Zipperer ..... B65H 54/26 57/264
7,010,383 B2 * 3/2006 Zipperer ..... B65H 54/26 700/139
7,113,843 B2 * 9/2006 Bahlmann ..... B65H 54/26 700/130
9,873,959 B2 * 1/2018 Stephan ..... D01H 4/50
2003/0056486 A1 3/2003 Bahlmann et al.

FOREIGN PATENT DOCUMENTS

DE 31 35 333 A1 3/1983
DE 195 12 592 A1 10/1996
DE 101 37 056 A1 2/2003
DE 101 48 330 A1 2/2003

OTHER PUBLICATIONS

German Patent Office Search Report, dated Apr. 15, 2016.
EPO Search Report, dated Dec. 21, 2016.

* cited by examiner

*Primary Examiner* — Shaun R Hurley
(74) *Attorney, Agent, or Firm* — Dority & Manning, P.A.

(57) ABSTRACT

A method is provided for operating a spinning machine with a multiple number of spinning stations. In the normal case, the individual spinning stations are supplied with a fiber material and produce a yarn. Upon the occurrence of predefined events, yarn production is interrupted at individual or all spinning stations, whereas such spinning stations are, when required, subjected to piecing with the assistance of a piecing process in order to start up yarn production again. The respective piecing is carried out with the assistance of handling tools associated with the spinning machine. The individual spinning stations are classified on the basis of one or more production-related parameters, and that, if more piecing processes are to be carried out at the same time than can be carried out by the handling tools, at least the selection of the spinning station to be subjected to piecing next is carried out under consideration of the specified classification.

10 Claims, No Drawings

SPINNING MACHINE AND METHOD FOR OPERATING A SPINNING MACHINE WITH A MULTIPLE NUMBER OF SPINNING STATIONS

FIELD OF THE INVENTION

The present invention relates to a method for operating a spinning machine with a multiple number of spinning stations, whereas, during a spinning operation, each of the individual spinning stations is supplied with a fiber material and produces a yarn, wherein, upon the occurrence of predefined events, yarn production is interrupted at any or all spinning stations. The spinning stations at which yarn production was interrupted, when required, start spinning again with the assistance of a piecing process, in order to restart yarn production. The respective piecing process takes place with the assistance of handling devices of the spinning machine.

Furthermore, a spinning machine with a multiple number of spinning stations for the production of yarn is proposed, whereas each of the spinning stations features at least one spinning unit with an inlet for a fiber material and an outlet for the yarn produced from the fiber material. Each of the spinning stations features a winding device for winding the produced yarn and a yarn monitoring unit for monitoring at least one yarn parameter of the yarn leaving the corresponding spinning unit.

BACKGROUND

Spinning machines conforming to this type may be formed as, for example, air jet spinning machines, which are used to produce a yarn from a strand-like fiber material (such as a fiber band) with the assistance of a vortex air flow generated by air nozzles within a vortex chamber. For this purpose, with the assistance of a delivery device, which is preferably formed by a pair of output rollers of a drafting system upstream of the spinning unit in the direction of spinning, a strand-like fiber material is conveyed in the direction of the spinning unit and is sucked or drawn in by it through negative pressure. The fiber material ultimately enters the interior of the spinning unit and there into the area of the inlet mouth of a spindle-shaped yarn formation element. The outer fibers of the strand-like fiber material are wound around the inner fibers with the assistance of the vortex air flow in the area of the inlet mouth generated by the air nozzles, such that the result is a stable yarn, which, with the assistance of a draw-off device arranged outside of the spinning unit, is ultimately drawn out through the draw-off channel from the vortex chamber, and is spooled on a tube by means of the winding device.

Likewise, the spinning machine in accordance with the invention may also be formed as a so-called rotor spinning machine, which is adequately described in the state of the art, the principle of which consists of the fact that the fibers of a likewise strand-shaped fiber material are separated with the assistance of an opening device (usually in the form of an opening roller) and are fed to the rapidly rotating rotor of the spinning unit. Based on the rotor speed, the individual fibers are laid at the inner wall of the rotor, and are thereby twisted into each other. The twisted fibers may ultimately be drawn out through an outlet of the spinning unit and spooled onto a sleeve of a downstream winding device.

If, during the spinning process, spinning errors (non-tolerable hairiness or thick or thin parts in the yarn, unsatisfactory supply of fiber material, etc.) arise, or if one or more spinning stations is turned off for a certain period of time, yarn production must be interrupted at the respective spinning station(s). This occurs, for example, by stopping the unit delivering the fiber material into the spinning unit (such as the drafting system of an air jet spinning machine) and/or the spinning unit itself. If yarn production is restarted after the stopping of yarn production and, in particular, after the removal of the faulty yarn section, a piecing process is necessary at the previously stopped spinning station.

Herein, the coil-side end of the already produced yarn (that is, the end section of the yarn section last spooled before the interruption of yarn production) is returned counter to the actual spinning direction, and possibly after one or more intermediate steps (for example, a yarn end preparation), through the outlet of the spinning unit, into or through it. Subsequently, the yarn end is brought into contact with the fiber material fed to the spinning unit or the correspondingly fed individual fibers, and is drawn off in the direction of spinning out of the spinning unit. Thereby, normal spinning operation is ultimately resumed, with which a yarn is produced from the fiber material fed to the spinning unit.

Generally, it then occurs again and again that a piecing process must be carried out at multiple spinning stations simultaneously (for example, during the start-up of the spinning machine, upon which a piecing has to be carried out at all of the spinning stations, or after the interruption of yarn production at multiple spinning stations). Herein, however, the problem arises that the spinning machine is usually designed to carry out a limited number of simultaneous piecing processes. If the piecing process is carried out or supported by, for example, by a service unit (a so-called "service robot") that is movable back and forth along the spinning stations, the number of simultaneously piecing spinning stations is limited by the number of service units. Likewise, the number is limited if the piecing processes are carried out by piecing devices associated with the spinning stations, since these have a certain energy and in particular a certain need for compressed air or negative pressure, which can be covered by the spinning machine only up to a certain degree.

Thus, as a result, only a certain number of piecing processes can always be carried out simultaneously, whereas it is customary in the state of the art to execute the piecing processes at the spinning stations in the chronological sequence in which they were previously stopped. Even if this approach is quite simple to realize in terms of control technology, there is a need for improvement to reduce the total time required to carry out the piecing processes per hour of operation of the spinning machine.

DESCRIPTION OF THE INVENTION

Therefore, a task of this present invention is to improve the described spinning process in such a manner that the efficiency of the spinning machine is improved. Additional objects and advantages of the invention will be set forth in part in the following description, or may be obvious from the description, or may be learned through practice of the invention.

The tasks are solved by a method and a spinning machine with the characteristics described and claimed herein.

Within the framework of the method in accordance with the invention, it is now provided that, during the spinning operation of each of the spinning stations, the yarn leaving the spinning units of the individual spinning stations is monitored with the assistance of the yarn monitoring units allocated to the individual spinning stations (for example, by means of sensors monitoring yarn in optical or capacitive terms). The monitored yarn parameters may be, for example, the thickness or the hairiness of the yarn and/or the chronological change of corresponding yarn parameters. If one or more yarn parameters deviate from a given target or if specified limits are exceeded, yarn production is interrupted at the respective spinning station. Likewise, it may be necessary to interrupt yarn production at one or more spinning stations for maintenance or repair purposes. After all of these pre-defined events, a piecing process is necessary at the previously stopped spinning station, in order to proceed with yarn production.

In contrast to the state of art, the present invention is distinguished by the fact that the individual spinning stations are classified on the basis of one or more production-related parameters (that is, they are assessed qualitatively), and that, if more piecing processes are to be carried out simultaneously than can be carried out by the handling devices responsible for the piecing (service robots and/or piecing devices associated with the spinning stations, such as suction or blast nozzles), at least the selection of the spinning station of the next piecing process takes place under consideration of the specified classification.

The sequence of the spinning stations for the successive piecing processes is not governed, or at least not exclusively governed, by the sequence in which yarn production was previously stopped at the respective spinning stations. Rather, for the chronological sequence for the piecing processes at the spinning stations, the parameters specified or established for the individual spinning stations are taken into account. The parameters are, as explained in more detail below, factors that are determined individually for each spinning station, and with the assistance of which the individual spinning stations can be characterized with respect to their yarn production behavior and/or piecing behavior. If the parameters are taken into account upon the selection of the spinning station for the next piecing process, the overall time that is required for the piecing of the spinning stations of the spinning machine per hour of operation is minimized, and/or the overall efficiency of the spinning machine can be increased.

As a result, therefore, the sequence of the spinning stations that are successively spun in deviates at least partially from the sequence in which yarn production was previously stopped at the respective spinning stations.

Advantageously, if fewer piecing processes are currently simultaneously carried out than can be carried out by the handling devices, the selection of the spinning station for the next piecing process takes place without consideration of the specified classification. In this case, the piecing processes of the individual spinning stations can be carried out, for example, in the chronological sequence in which yarn production was previously stopped at the respective spinning stations. Thus, the chronological sequence of the spinning stations for the successive piecing processes depends, among other things, on whether, at a specified point in time, more spinning stations require a piecing process than can be carried out by the handling devices provided for this purpose.

In particular, the parameters specified below come into consideration as parameters, whereas one or more of the parameters can be taken into account in the determination of the spinning stations to be successively subjected to piecing. At this point, it must be noted that the sequence is preferably specified by a control unit of the spinning machine or a control unit in operative connection with it, whereas, in the specification, the corresponding parameter(s) is or are taken into account; that is, it/they flows/flow into the mathematical model that is saved for this purpose. Thus, the parameters may directly influence the sequence of the spinning stations for the piecing process. Alternatively, it would also be possible to calculate one or more parameter(s) or one or more additional parameter(s), and specify the sequence on the basis of the parameter(s) obtained in this manner. In any event, the corresponding parameters for each spinning station should be determined separately, in order to be able to undertake a corresponding individual classification of the spinning stations.

The following are possible as parameters:

- the probability of success of a piecing process at the corresponding spinning station; that is, on average, after how many piecing attempts a successful piecing process succeeds; compared to spinning stations with a relatively lower probability of success, spinning stations with a higher probability of success should preferably be subjected to piecing.
- number of piecing processes commenced per time unit in the past; that is, how frequently an interruption of yarn production arises at the respective spinning station per time unit; compared to spinning stations with a relatively high number, spinning stations with a smaller number of piecing processes should preferably be subjected to piecing.
- number of piecing processes completed in the past per time unit, in particular in relation to the number of piecing processes commenced in the past; compared to spinning stations with a relatively low relation, spinning stations with a higher relation should preferably be subjected to piecing.
- time that has elapsed at the respective spinning station since the interruption of yarn production; this is an indication of the reliability of the spinning station or a measure of the amount of yarn produced per time unit; compared to spinning stations for which a relatively short time has elapsed, spinning stations for which a long period of time has elapsed since the last interruption should preferably be subjected to piecing.
- time that has elapsed since the commencement or conclusion of the most recently commenced piecing process, whereas compared to spinning stations for which the time period is relatively shorter, spinning stations, for which the corresponding time period is longer should preferably be subjected to piecing.
- yarn quantity or yarn length produced in the past per time unit; compared to spinning stations with a lower time-related yarn quantity/yarn length, spinning stations with a higher time-related yarn quantity or yarn length should preferably be subjected to piecing.
- operating time of selected components of the respective spinning station, since the piecing behavior or the production speed of the individual spinning stations often depend directly or indirectly on the operating time; compared to spinning stations, the selected components of which feature relatively longer operating times, spinning stations with shorter operating times of selected components (such as the drafting system rollers or their components or of the yarn formation element of an air jet spinning machine or of the rotor of a rotor spinning machine) should preferably be subjected to piecing.
- number of piecing processes during the production of a yarn package; this value indicates how often interruptions in yarn production arise, that is, how reliably the corresponding spinning station is working; accordingly, compared to those spinning stations for which, viewed relatively, interruptions frequently arise, spinning stations for which interruptions less frequently arise should preferably be subjected to piecing.

cause for the interruption in yarn production; for example, a spinning station, for which yarn production was interrupted based on a short-term variation in thickness, should preferably be subjected to piecing, compared to a spinning station for which a variation in thickness of over several meters of yarn was observed prior to the interruption of yarn production, since, in this case, the unit that supplies fiber material to the spinning unit may not correctly function and may have to be readjusted.

number of piecing processes depending on the yarn quantity already produced at the respective spinning station (whereas the yarn quantity produced over a predefined time period is used as the basis).

It is also advantageous if individual spinning stations are temporarily not subjected to piecing, depending on their classification. For example, it would be conceivable to temporarily block spinning stations, for which one or more parameter(s) is(are) outside of defined threshold values, from the piecing process. The removal of the block may take place, for example, after a predetermined time period or manually. Likewise, the blocking of individual spinning stations may take place manually or automatically with the assistance of the control unit, whereas, upon an automatic blocking, a message may be outputted to an operator of the spinning machine (for example, in the form of a visual signal). For example, it would be conceivable not to subject individual spinning stations to piecing for a certain period of time if the number of spinning stations that require piecing simultaneously exceeds a defined amount, whereas, in such a case, forecasts regarding the piecing processes to be expected could be taken into account in a period of time in the future.

It is also extremely advantageous if individual spinning stations are temporarily not subjected to piecing, depending on the overall efficiency of the spinning machine. One dimension for assessing the overall efficiency would be, for example, the yarn quantity or yarn length, produced per time unit, averaged through the spinning stations that are not blocked. If the overall efficiency of the spinning machine decreases over time, individual or additional spinning stations can be blocked from the piecing process. If the efficiency increases over time, individual or all previously blocked spinning stations could be released again for the piecing process.

It is particularly advantageous if the spinning stations that were temporarily not subjected to piecing in accordance with the previous description are subjected to piecing once again, if the overall efficiency of the spinning machine reaches or exceeds a defined value. In other words, there may be a saving of threshold values, upon the exceeding or falling below of which individual spinning stations are automatically blocked from the piecing process or are once again released for it, whereas the selection of the spinning stations to be blocked or once again released is to take place on the basis of the parameters specified above.

It is likewise conceivable to—irrespective of a classification that took place—once again subject individual or all spinning stations to piecing that were previously not subjected to piecing, by means of a corresponding control command, for example, if a batch change is pending (that is, a different type of yarn is to be produced on the spinning machine).

It is advantageous if the spinning stations temporarily not subjected to piecing in accordance with the previous description are once again subjected to piecing, if the number of piecing processes that were actually carried out or were requested by the individual spinning stations reaches or falls below a defined value. For example, a value X (for example, 5), which states that up to X spinning stations could be simultaneously subjected to piecing, could be saved in the control unit. If, for example, the number of spinning stations to be subjected to piecing at a certain point in time is at X+2, 2 spinning stations would be temporarily blocked from the piecing process. If, because of successfully carried out piecing processes, the number falls once again to a value below the specified value X, additional spinning stations that were previously blocked may be subjected to piecing.

It is likewise advantageous if the piecing process is carried out at least partially, preferably exclusively, with the assistance of handling devices associated with the spinning stations. These include, for example, suction or blowing nozzles or mechanically acting devices, such as gripping elements or pairs of rollers, with which the yarn can be guided or transported.

It may also be advantageous if, in carrying out the piecing processes, a service unit (a so-called "service robot") that is movable back and forth between individual spinning stations is involved, or if the piecing processes are carried out exclusively with the assistance of corresponding service units, whereas the movement of the service unit takes place under consideration of the specified classification (whereas, of course, multiple service units may also be used). In other words, the service unit(s) does/do not move, or does/do not always move, to the spinning stations to be subjected to piecing, which is closest to the service unit. Rather, one or more of the parameters specified above of the spinning stations to be subjected to piecing are also taken in account, such that the service unit(s) at least partially also subject spinning stations to piecing first that are further away than other spinning stations to be subjected to piecing.

It is advantageous if the classification of the individual spinning stations takes place on a regular basis; that is, in predetermined time intervals. Preferably, the classification takes place continuously. It is thereby ensured that, for example, spinning stations that have a particularly high rate of production or a particularly reliable piecing behavior are preferably subjected to piecing. Since the amounts of the monitored parameters may always change, the piecing priority of the individual spinning stations (that is, what spinning station is preferably subjected to piecing compared to another) may also constantly change.

Finally, the invention relates to a spinning machine with the physical characteristics described above, whereas the spinning machine comprises a control unit or is in operative connection with a control unit that is designed to operate the spinning machine according to the previously described aspects (whereas the aspects may be realized individually or in any combination). In particular, the spinning machine also features sensors, with the assistance of which the parameters considered upon piecing can be determined.

The invention is not limited to the illustrated and described embodiments. Variations within the framework of the patent claims, such as any combination of the described characteristics, even if they are illustrated and described in different parts of the description or the claims.

The invention claimed is:

1. A method for operating a spinning machine with a multiple number of individual spinning stations, comprising:

during spinning operation of the spinning machine, the individual spinning stations are supplied with a fiber material and produce a yarn;

upon occurrence of predefined events, yarn production is interrupted at individual or all of the individual spinning stations;

with a piecing process, yarn production is restarted at one or more of the individual spinning stations at which yarn production was interrupted, the piecing carried out with the assistance of handling tools associated with the spinning machine;

wherein, for the restarting of yarn production, the individual spinning stations are classified on a basis of one or more production-related parameters and, in the event that more piecing processes are to be carried out that exceeds capability of the handling tools for a given period of time, priority of the spinning stations for piecing is selected by consideration of the specified classification of the individual spinning stations, wherein the production-related parameters include more than an order in which yarn production was interrupted at the individual spinning stations; and one or more of the spinning stations are blocked from the piecing process when one or more of the production-related parameters associated with the blocked spinning stations exceeds a threshold value such that the blocked spinning stations are not included in the priority of the spinning stations for piecing until subsequently released for piecing.

2. The method according to claim 1, wherein, in the event the number of piecing processes to be carried out does not exceed the capability of the handling tools, the priority of the spinning stations for piecing is carried out without consideration of the specified classification of the individual spinning stations.

3. The method according to claim 1, wherein the production-related parameters are determined or calculated for each of the individual spinning stations and include one or more of the following:

probability of success of a piecing process at the spinning station;

number of past piecing processes begun at the spinning station per unit of time;

number of past piecing processes ended at the spinning station per unit of time;

time that has elapsed since the interruption of yarn production at the spinning station;

time that has elapsed since start or end of a most recently started piecing process at the spinning station;

yarn quantity or yarn length produced in the past at the spinning station per unit of time;

operating time of selected components of the spinning station;

number of piecing processes during production of one yarn package at the spinning station; and cause of the interruption of yarn production at the spinning station.

4. The method according to claim 1, wherein the blocked spinning stations are determined depending on an overall efficiency of the spinning machine.

5. The method according to claim 4, wherein the blocked spinning stations are released for subsequent piecing when the overall efficiency of the spinning machine reaches or exceeds a defined value.

6. The method according to claim 4, wherein the blocked spinning stations are released for subsequent piecing when a number of the piecing processes being carried out reaches or falls below a defined value.

7. The method according to claim 1, wherein the handling tools for carrying out the piecing processes are associated with the spinning stations.

8. The method according to claim 1, wherein one or more service units move back and forth between individual spinning stations for carrying out the piecing processes, wherein movement of the service unit(s) is carried out under consideration of the specified classification of the individual spinning stations.

9. The method according to claim 1, wherein the classification of the individual spinning stations is carried out continuously or on a planned periodic basis.

10. A spinning machine with a multiple number of spinning stations for production of yarn, comprising:

each spinning station comprising a spinning unit with an inlet for a fiber material and an outlet for the yarn produced from the fiber material;

each spinning station comprising a winding device for winding up the produced yarn and a yarn monitoring unit for monitoring at least one yarn parameter of the yarn leaving the spinning unit; and a control unit configured to operate the spinning machine in accordance with the method of claim 1.

* * * * *